US008759704B2

(12) United States Patent
Inamoto et al.

(10) Patent No.: US 8,759,704 B2
(45) Date of Patent: Jun. 24, 2014

(54) SWITCH

(75) Inventors: Shigenori Inamoto, Sagamihara (JP); Yukihiro Takimoto, Tendo (JP); Chikara Sekiguchi, Yamato (JP)

(73) Assignee: Mitsumi Electric Co., Ltd., Tama-shi, Tokyo (JP)

( * ) Notice: Subject to any disclaimer, the term of this patent is extended or adjusted under 35 U.S.C. 154(b) by 132 days.

(21) Appl. No.: 13/468,385

(22) Filed: May 10, 2012

(65) Prior Publication Data

US 2012/0292171 A1 Nov. 22, 2012

(30) Foreign Application Priority Data

May 19, 2011 (JP) ..... 2011-112171

(51) Int. Cl.
*H01H 5/18* (2006.01)

(52) U.S. Cl.
USPC ..... 200/406

(58) Field of Classification Search
USPC ..... 200/310, 5 A, 5 R, 511–513, 520, 521, 200/308, 311, 313, 314, 317, 337, 341, 343, 200/345, 292, 329, 406
See application file for complete search history.

(56) References Cited

U.S. PATENT DOCUMENTS

| | | | | |
|---|---|---|---|---|
| 5,924,555 | A * | 7/1999 | Sadamori et al. | 200/512 |
| 8,362,381 | B2 * | 1/2013 | Itou | 200/512 |
| 2008/0142350 | A1 * | 6/2008 | Karaki et al. | 200/512 |
| 2008/0164133 | A1 * | 7/2008 | Hayafune | 200/516 |

FOREIGN PATENT DOCUMENTS

| | | | |
|---|---|---|---|
| JP | 10-116639 | A | 5/1998 |
| JP | 10-125172 | A | 5/1998 |
| JP | 2006-252887 | A | 9/2006 |
| JP | 2008-177155 | A | 7/2008 |
| JP | 2008-269864 | A | 11/2008 |

* cited by examiner

*Primary Examiner* — Edwin A. Leon
*Assistant Examiner* — Anthony R. Jimenez
(74) *Attorney, Agent, or Firm* — Holtz Holtz Goodman & Chick PC

(57) ABSTRACT

A switch includes a click spring, stationary contacts, a spring holding sheet, a switch base, and a nub disposed on the sheet and having a non-linear acting load to displacement characteristic. Spring constant k11 (tangent gradient of the characteristic curve of the a nub at an origin point), spring constant k3 (gradient of a line connecting a point corresponding to a peak acting load and an origin point of a characteristic curve of the click spring and the sheet), spring constant k12 (tangent gradient at an arbitrary point of a non-linear portion of the characteristic curve of the nub), and displacement s11 (displacement corresponding to an intersection point of the line having the gradient k11 and the line having the gradient k12) satisfy k11<k3, k12>k3, and 0<s11<S1.

3 Claims, 15 Drawing Sheets

SWITCH

CROSS-REFERENCE TO RELATED APPLICATION

The present U.S. application claims a priority under the Paris Convention of Japanese Patent Application No. 2011-112171 filed on May 19, 2011, which shall be a basis of correction of an incorrect translation.

BACKGROUND

1. Field of the Invention

The present invention relates to a switch having a tactile (click) spring.

2. Description of Related Art

It is generally known to use a switch with a tactile (click) action for an inputting key of an electronic device such as a mobile phone. A switch with a click action can provide a tactile (click) feel to a user when a user presses the switch. Such a switch with a click action is provided with a tactile (click) spring.

A conventional switch 1*a* will be explained with reference to FIGS. 10 and 11. FIG. 10 is a sectional structure of a conventional switch 1*a*. FIG. 11 shows a characteristic of displacement against acting load of the conventional switch 1*a*.

The switch 1*a* has, as shown in FIG. 10, a tactile (click) spring 2, switch base 3, stationary contacts 4, 5 and 6, and spring holding sheet 7. The click spring 2 is a dome-shaped spring as a contact and made of conducting metal. The click spring 2 has a circular shape in a plan view and the center of the circle is designated as a movable contact 2*a*. FIG. 10 is a cross-sectional view along a plane passing through the movable contact 2*a* of the click spring 2.

The switch base 3 is a base on which the click spring 2 is disposed and supports the spring holding sheet 7. The switch base 3 is provided with stationary contacts 4, 5 and 6. The stationary contacts 4, 5 and 6 are electrical contacts made of conducting metal. The stationary contacts 4 and 5 continuously contact and support the click spring 2. The stationary contact 6 is located at a position corresponding to the movable contact 2*a* of the click spring 2. The spring holding sheet 7 is adhered on the click spring 2 and fixes the position of the click spring. 2

An acting load is applied on the movable contact, within a press-down operation region R, of the click spring 2 of the switch 1*a* from vertically upside by a user, and a click feel is generated. The click feel felt by the user operator depends largely on characteristics of the click spring 2. In general, such a click feel can be measured by an acting load and displacement measurement device and can be shown in numeral form as an acting load to displacement curve as shown in FIG. 11, for example. A displacement (mm) indicated by a horizontal axis of FIG. 11 is a vertical displacement of the movable contact 2*a* of the click spring 2. An acting load (gf) indicated by a vertical axis of FIG. 11 is a vertical acting load applied to the movable contact 2*a*.

As shown in FIG. 11, by applying an acting load onto the click spring 2, on which no acting load is applied at an initial state, the click spring 2 starts to deform and the displacement increases almost in a proportional relation to the increase of the acting load. By increasing of the acting load more, a click action by buckling occurs at a point of a peak acting load of F1 and a displacement of S1 and a center portion of the click spring 2 reverses to cause a displacement by an acting load smaller than the acting load F1 (acting load decreases as the displacement increases). Finally, the movable contact 2*a* makes in contact with the stationary contact 6 at the bottom position of an acting load F2 and displacement S2. As a result, the stationary contact 4 and 5 are brought into conduction with the stationary contact 6 through the click spring 2. When the acting load becomes zero by releasing the press down, the click spring 2 returns to the initial shape.

A click ratio is known as an indicator of the tactile feel that is defined as (acting load F1−acting load F2)/(acting load F1)×100(%). The click ratio is a variable indicating the degree of comfort of the click feel. It is also known that when a pressing position is misaligned from the center of the click spring 2 (position corresponding to movable contact 2*a*), an intrinsic acting load to displacement curve cannot be obtained and the click ratio may be decreased. Such a misalignment of the pressing position is caused by a tolerance of a casing, assembling misalignment or mounting misalignment on a circuit substrate, and the like. In order to suppress the decline of the click ratio caused by the pressing position misalignment, a method is known to provide a Nub (projection) on the spring holding sheet 7 (see Patent documents JP2008-269864A, JP2008-177155A, JP2006-252887A, JPH10-125172A, and JPH10-116639A, for example).

A conventional switch 1*b* having a Nub 8*b* will be explained with reference to FIGS. 12 to 15. FIG. 12 is a sectional structure of a conventional switch 1*b*. FIG. 13 is an acting load to displacement characteristic of the conventional switch 1*b*. FIG. 14 is an acting load to displacement characteristic of the conventional Nub 8*b*. FIG. 15 is a mechanical model of the conventional switch 1*b*.

As shown in FIG. 12, the switch 1*b* includes a click spring 2, switch base 3, stationary contacts 4, 5 and 6, spring holding sheet 7 and Nub 8*b*. The Nub 8*b* is adhered to the spring holding sheet 7 by an adhesive 9. The Nub 8*b* is formed into a predetermined shape by a synthetic resin using a molding die.

The acting load to displacement characteristic of the click spring 2 is transmitted to the switch 1*b* via the spring holding sheet 7, the adhesive 9 and the Nub 8*b* in this order and measured as an acting load to displacement characteristic of the switch 1*b*, as shown in FIG. 13. The click spring 2 of the switch 1*b*, as the switch 1*a*, has tactile response. When the acting load F is applied on the click spring 2 of the switch 1*b*, the acting load increases almost proportional (linear) to the displacement and the click spring 2 buckles at the point of the acting load F1. Then a center of the click spring 2 reverses and starts displacement by an acting load smaller than the acting load F1.

As shown in FIG. 14, an acting load to displacement characteristic of the Nub 8*b* increases an acting load almost proportional (linear) to displacement. The gradient of the line is designated as a spring constant k1. In the same fashion, a spring constant of the spring holding sheet 7 and the Nub 8*b* is designated as k2. The mechanical model of such a switch 1*b* is described as two springs 81 and 82 that are connected in series as shown in FIG. 15. The springs 81 and 82 have spring constants k1 and k2, respectively.

As shown in FIG. 13, the acting load to displacement curve of the conventional switch 1*b* is linear until the acting load reaches to the peak acting load F1. Therefore, when the switch is downsized (small or low in profile), a displacement (stroke) S1 to the peak acting load F1 becomes smaller and comfortable operation (tactile) feel is not obtained.

SUMMARY

An object of the present invention is to provide a downsized switch having comfortable tactile feel.

In accordance with a first aspect of the present invention, a switch includes a click spring that generates a tactile action by being pressing down and including a circumferential edge and a movable contact, a spring holding sheet that is attached to the click spring, a switch base provided with a first and a second stationary contacts, for supporting the spring holding sheet, and an Nub disposed on the spring holding sheet and having a non-linear acting load to displacement characteristic. The circumferential edge of the click spring is continuously in contact with the first stationary contact and the movable contact of the click spring makes in contact with the second stationary contact at a time of the tactile action.

A spring constant k11, a spring constant k3, a spring constant k12, a displacement S1 and a displacement s11 are defined as follows and satisfy following inequalities of k11<k3, k12>k3, and 0<s11<S1.

The spring constant k11 is a gradient of a tangent line at an origin point of the acting load to displacement characteristic curve of the Nub.

The displacement S1 is a displacement that an acting load of an acting load to displacement characteristic curve of the click spring and the spring holding sheet shows a peak.

The spring constant k3 is a gradient of a line connecting a point corresponding to the peak acting load and an origin point of the acting load to displacement characteristic curve of the click spring and the spring holding sheet.

The spring constant k12 is a gradient of a tangent line at an arbitrary contacting point within a non-linear portion of the acting load to displacement characteristic curve of the Nub.

The displacement s11 is a displacement of an intersection point of two lines of the line having the gradient k11 and the line having the gradient k12.

Preferably, the Nub is formed so as to obtain the desired displacement s11.

Preferably, the Nub is formed in a cylindrical shape having a diameter to obtain the desired displacement s11. A value of the displacement s11 becomes small as the diameter of the cylindrical shape becomes large.

According to the present invention, a switch having comfortable tactile feel can be obtained even when a size of the switch is small.

BRIEF DESCRIPTION OF THE DRAWINGS

The present invention will become more fully understood from the detailed description given hereinbelow and the accompanying drawings which are given by way of illustration only, and thus are not intended as a definition of the limits of the present invention, and wherein.

DETAILED DESCRIPTION OF THE PREFERRED EMBODIMENTS

Exemplary embodiments of the present invention will be explained with reference to attached drawings. The scope of the invention, however, is not limited to the embodiments.

(Exemplary Embodiments)

Figure 1:
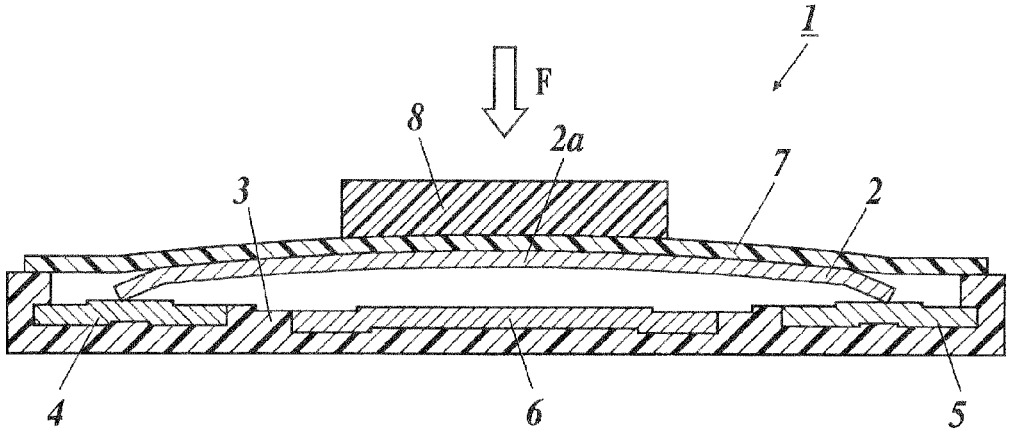
FIG. 1 is a sectional drawing of a switch according to an exemplary embodiment of the present invention.

Exemplary embodiments of the present invention will be explained with reference to FIGS. 1 to 9. At first, a structure of a switch 1 of an exemplary embodiment will be explained with reference to FIG. 1. FIG. 1 shows a sectional structure of the switch 1.

The switch 1 of an exemplary embodiment is used for an operating portion of an electronic device, for example. The electronic device is provided with an operating portion for pressing switches and is a mobile phone, PHS (Personal Handyphone System), PDA (Personal Digital Assistant), smart phone, handy game machine, and the like.

As shown in FIG. 1, the switch 1 is provided with a tactile (click) spring 2, switch base 3, stationary contacts 4, 5 and 6, spring holding sheet 7 and Nub 8. The click spring 2 is a dome-shaped spring as a contact made of conducting metal and can perform a tactile action (click action). A material for the click spring 2 is a conducting metal such as a stainless steel such as SUS 301 (stainless steel strip for spring), copper-beryllium, phosphor-bronze for spring, and the like. However, it is not limited to these materials but any material can be used as far as it is generally used for a spring.

The click spring 2 has a circular shape in a plan view of FIG. 1. A plane center of a top view of the click spring 2 is a movable contact 2*a*. At least a part of a neutral plane, which is shown in the cross-section of the click spring 2, is spherical or aspherical. A "neutral plane" is a plane existing at a boundary of a compressed side and a tensile side, and is not stretched nor compressed. The click spring 2 has a convex shape expanding to the reverse direction of a pressing-down (downward) direction by a user.

The switch base 3 is a switch case made of glass-nylon resin, for example. The click spring 2 is disposed on the switch base 3 and the switch base 3 supports the sping holding sheet 7. The switch base 3 is provided with stationary contacts 4, 5 and 6. The stationary contacts 4, 5 and 6 are fixed electric contacts made of conducting metal such as a copper foil. The stationary contacts 4 and 5 contact-support a circumferential edge of the click spring 2 continuously. The stationary contact 6 is formed at a position corresponding to the movable contact 2*a* of the click spring 2. The stationary contact 6 is not in contact with the click spring 2 in a state when the click spring 2 is not pressed down (no acting load F is applied) by a user.

The spring holding sheet 7 is an insulation sheet made by a polyimide film, for example. The spring holding sheet 7 is attached on the surface of the click spring 2 and the switch base 3. The spring holding sheet 7 has a role to fix a position of the click spring 2 on the switch base 3 in a plan view. The position is defined such that the click spring 2 is in contact with the stationary contacts 4 and 5 and the movable contact 2*a* of the click spring 2 makes in contact with the stationary contact 6 when the click spring 2 buckled.

The Nub 8 is an Nub made of a material such as a UV (Ultra Violet) setting resin or polymer materials, for example, that has a non-linear acting load to displacement characteristic. The Nub 8 is arranged on the spring holding sheet 7 within a press-down operation region including the movable contact 2*a*. The acting load from a user can be appropriately transferred to the movable contact 2*a* even when a position of the press-down operation is shifted from the movable contact 2*a*.

Figure 2:
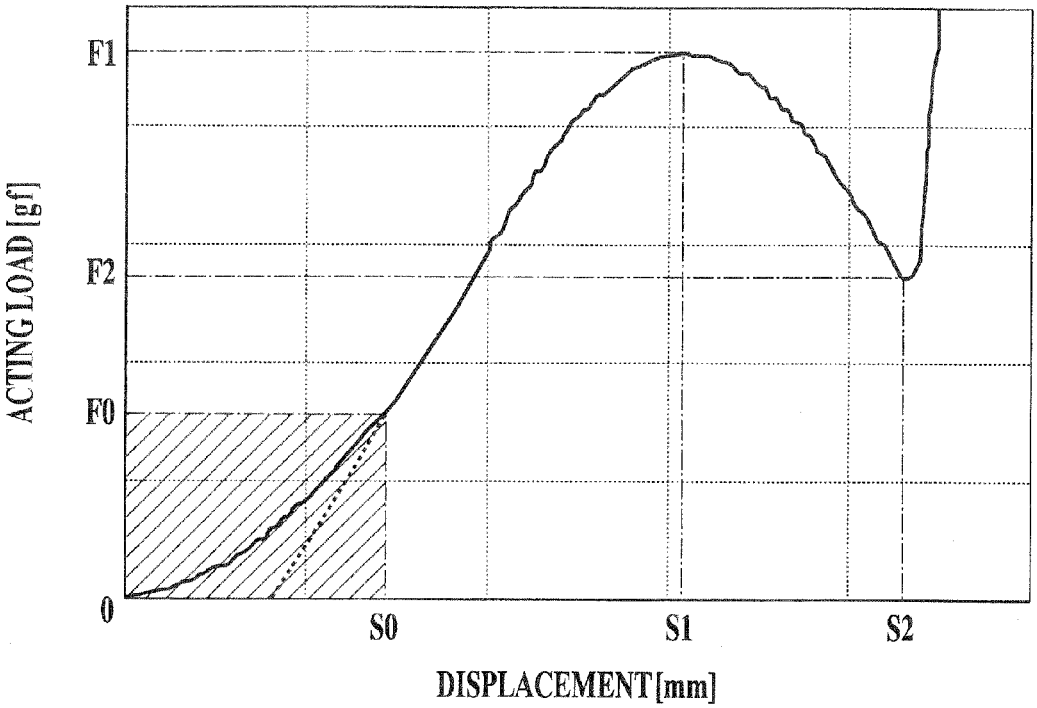
FIG. 2 is a graph showing an acting load to displacement characteristic of a switch of an exemplary embodiment.

Next, an operation of the switch 1 will be explained with reference to FIG. 2. FIG. 2 is an acting load to displacement characteristic of the switch 1.

Let us assume that a user presses the movable contact 2*a* at the center of the click spring 2 of the switch 1 at an acting load F. The acting load and displacement at the initial state, without applied load to the movable contact 2*a*, is zero. The acting load to displacement characteristic curve of the switch 1 is indicated in solid line in FIG. 2.

A user presses down the Nub 8 to apply an acting load F to the click spring 2 at the initial state of the switch 1. The pressing down operation is transferred to the movable contact 2*a* as the acting load F via the Nub and the spring holding sheet 7. The acting load F starts increasing in this way. As shown in FIG. 2, the acting load F increases non-linearly from displacement zero to displacement S0. An acting load corresponding to displacement S0 is defined as F0. The acting load F increases almost in proportional (linearly) from displacement S0 to S1.

The click spring 2 buckles at the acting load F1 corresponding to the displacement S1. The center portion of the click spring 2 including the movable contact 2*a* reverses and the movable contact 2*a* displaces with an acting load smaller than F1. The acting load F continues to decline until the movable contact 2*a* reaches to the displacement S2. The movable contact 2*a* makes in contact with the stationary contact 6 at the point of displacement S2 and the stationary contacts 4 and 5 electrically make in contact with the stationary contact 6 via the click spring 2. When the user releases the press down of the Nub 8 and the acting load F is removed, the click spring 2 returns to the initial state.

A tangent line at the point of displacement S0 and acting load F0 in the acting load to displacement characteristic curve of the switch 1 is indicated in a broken line in FIG. 2. The broken line teaches clearly that the characteristic curve of the switch 1 is non-linear in the range from the displacement zero to S0 and the acting load zero to F0 (hatched region in FIG. 2).

Figure 3:
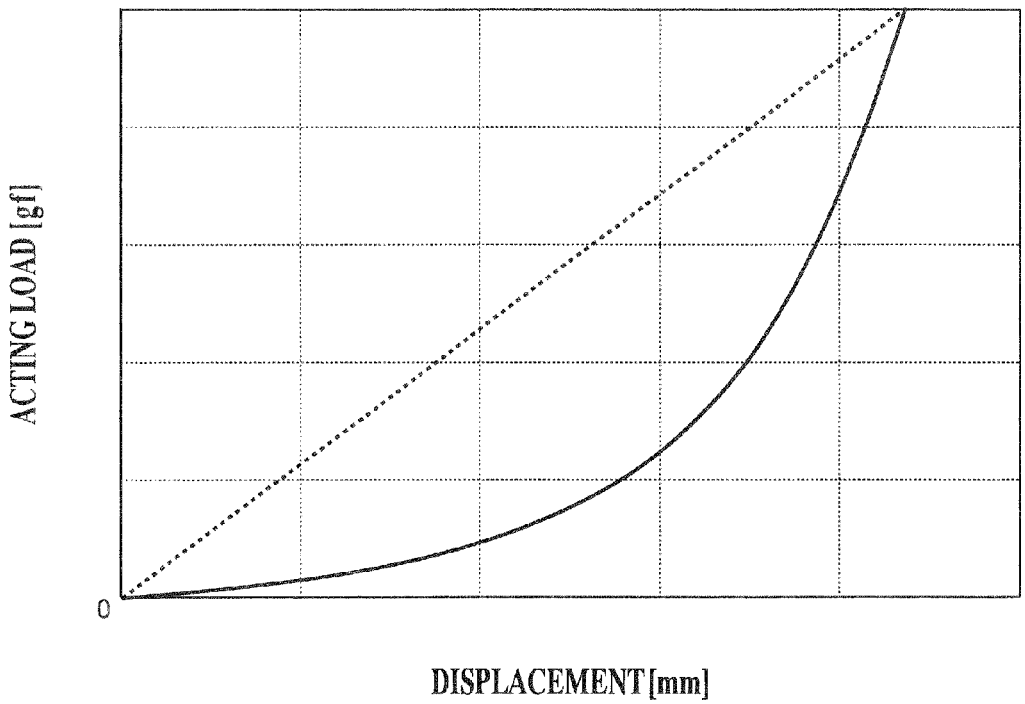
FIG. 3 is a graph showing acting load to displacement characteristics of a conventional Nub and an Nub of an exemplary embodiment, FIG. 4 a graph showing acting load to displacement characteristics of a conventional switch and a switch of an exemplary embodiment.
Figure 4:
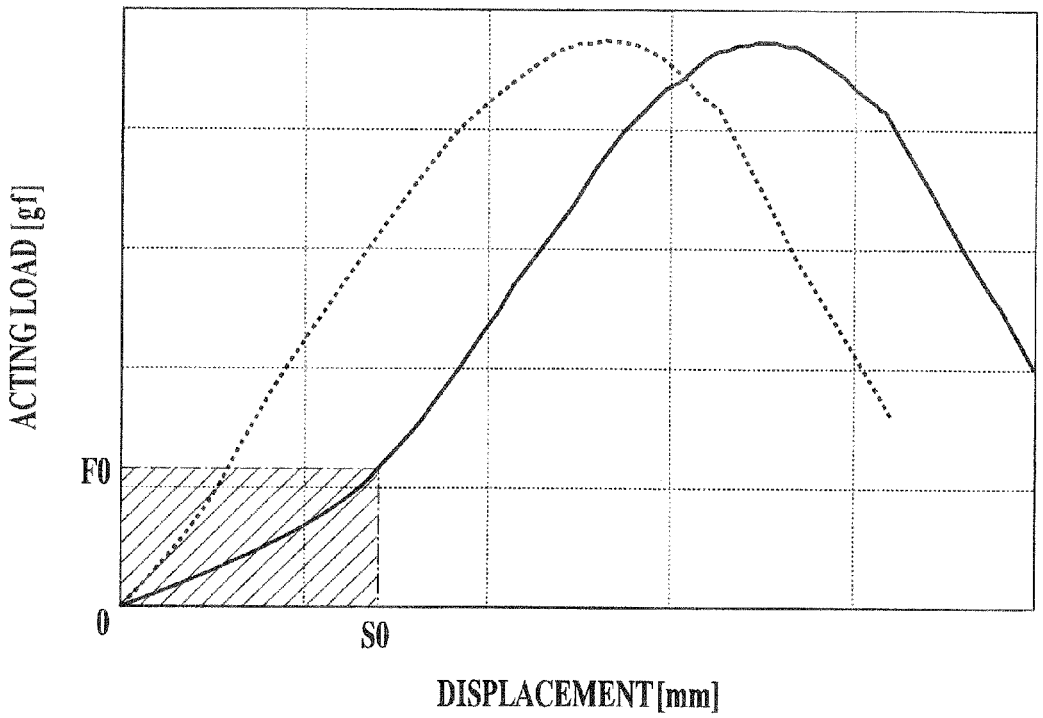

Next, the switch 1 of an exemplary embodiment will be compared with a conventional switch 1*b* with reference to FIGS. 3 and 4. FIG. 3 is shows acting load to displacement characteristic curves of the Nub 8 of an exemplary embodiment and a conventional Nub 8*b*. FIG. 4 shows acting load to displacement characteristic curves of the switch 1 of an exemplary embodiment and a conventional switch 1*b*.

The characteristic curves of the Nub 8 itself of an exemplary embodiment and a conventional Nub 8*b* will be explained with reference to FIG. 3. The characteristic curve of the Nub 8 itself is indicated in a solid line and the characteristic curve of the Nub 8*b* itself is indicated in a broken line in FIG. 3. According to the characteristic curve of the Nub 8 itself of an exemplar embodiment, the acting load increases non-linearly to the increase of the displacement, as shown in FIG. 3. On the other hand, the characteristic curve of the Nub 8*b* itself increases in proportional (linearly) to the displacement.

The acting load to displacement characteristic curves of the switch 1 of an exemplary embodiment and a conventional switch 1*b* will be explained with reference to FIG. 4. The characteristic curve of the switch 1 is indicated in a solid line and the characteristic curve of the switch 1*b* is indicated in a broken line in FIG. 4. According to the characteristic curve of the switch 1 of an exemplar embodiment, the acting load increases non-linearly to the increase of the displacement in a rising portion (a region from the displacement zero to S0 and the acting load zero to F0, hatched in FIG. 4). On the other hand, the characteristic curve of the switch 1*b* increases in proportional (linearly) to the displacement in the rising portion.

Figure 5:
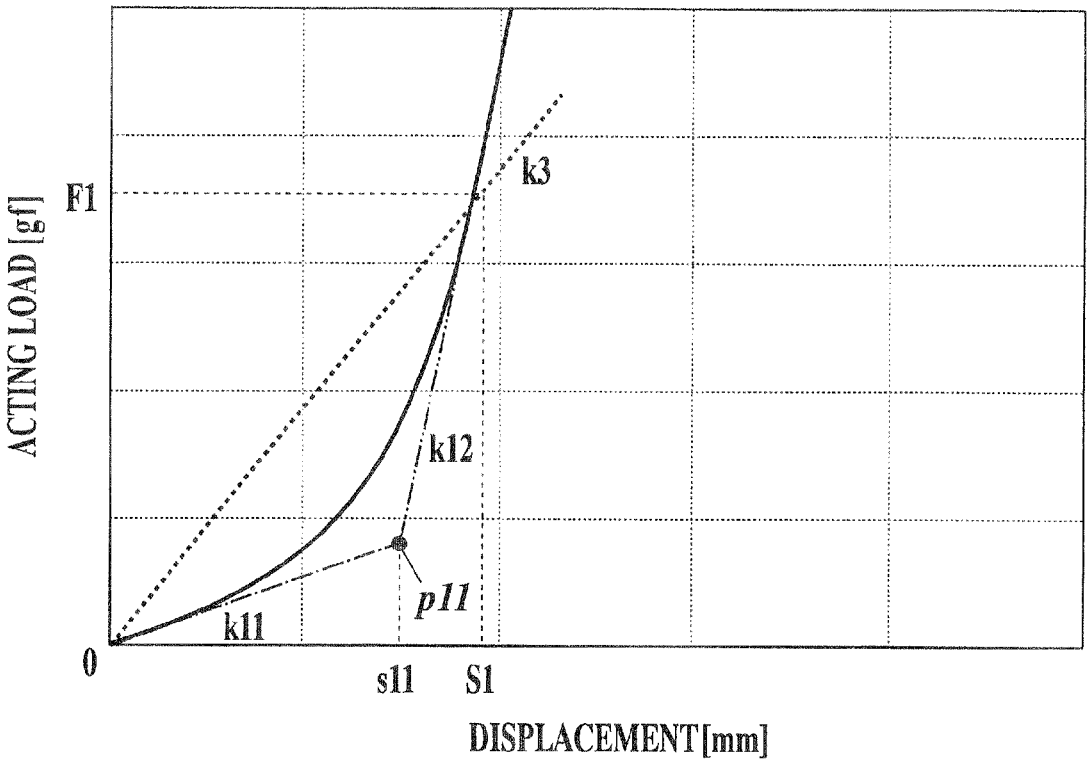
FIG. 5 is a graph showing an acting load to displacement characteristic and a spring constant of an Nub according to an exemplary embodiment.
Figure 6:
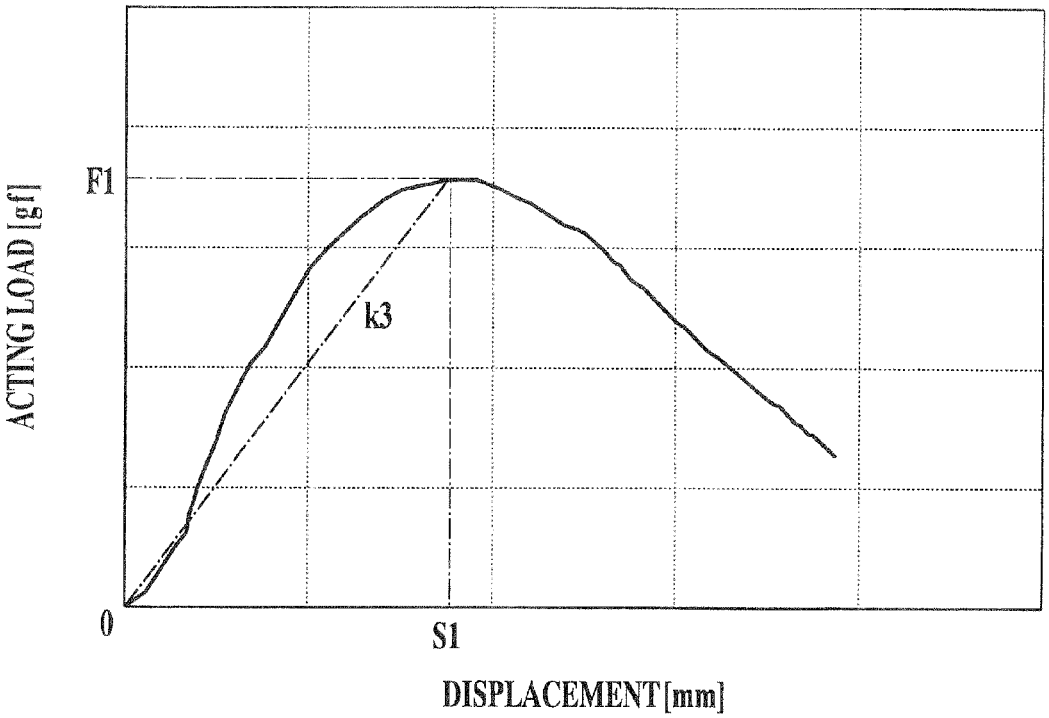
FIG. 6 is a graph showing an acting load to displacement characteristic and a spring constant of a click spring and a spring holding sheet.

Next, conditions to obtain comfortable operation (tactile) feel of the switch 1 will be explained with reference to FIGS. 5 and 6. FIG. 5 shows the acting load to displacement characteristic curve and spring constants k11, k12 and k3 of the Nub 8. FIG. 6 shows the acting load to displacement characteristic curve and a spring constant k3 of the click spring 2 and the spring holding sheet 7.

Figure 15:
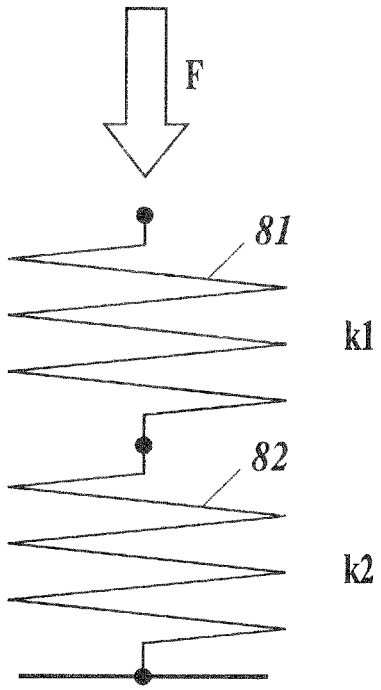
FIG. 15 is a mechanical model of a second conventional switch.

The mechanical model of the switch 1*b* shown in FIG. 15 will be applied to the switch 1. The spring constant k1 of the mechanical model is substituted by a spring constant k11 that is a gradient of the rising portion (tangent line at the origin point) of the characteristic curve of the Nub 8. A line having a gradient of the spring constant k11 and passing through the origin point is indicated in FIG. 5 by alternate long and short dashed line. The spring constant k3 is expressed as F1/S1 (F1 by S1) as shown in FIG. 6. The line having the gradient of the spring constant k3 is indicated in FIG. 5 in a broken line that passes through the origin point and the point of the displacement S1 and the acting load F1.

In the acting load to displacement characteristic curve of the Nub 8 of FIG. 5, a gradient of a tangent line at an arbitrary point in the non-linear portion is designated as a spring constant k12. The line having a gradient of the spring constant k12 is indicated by a chain double-dashed line in FIG. 5. A point of intersection of the line of the spring constant k11 and the line of the spring constant k12 is designated as an intersection p11. The intersection p11 is an inflection point at which the gradients of the lines change from the spring constant k11 to the spring constant k12.

The spring constants k11, k12 and k3 satisfy following condition inequalities (1) and (2):

$$K11<k3 \quad (1) \text{ and}$$

$$K12>k3 \quad (2).$$

The displacement s11 of the intersection p11 satisfies following inequality (3):

$$0<s11<S1 \quad (3).$$

A non-linear acting load to displacement characteristic of the switch 1 at the rising portion can be obtained when each of the constants of the switch 1 satisfies the inequalities (1), (2) and (3) and comfortable tactile feel can be obtained thereby.

Figure 7A:
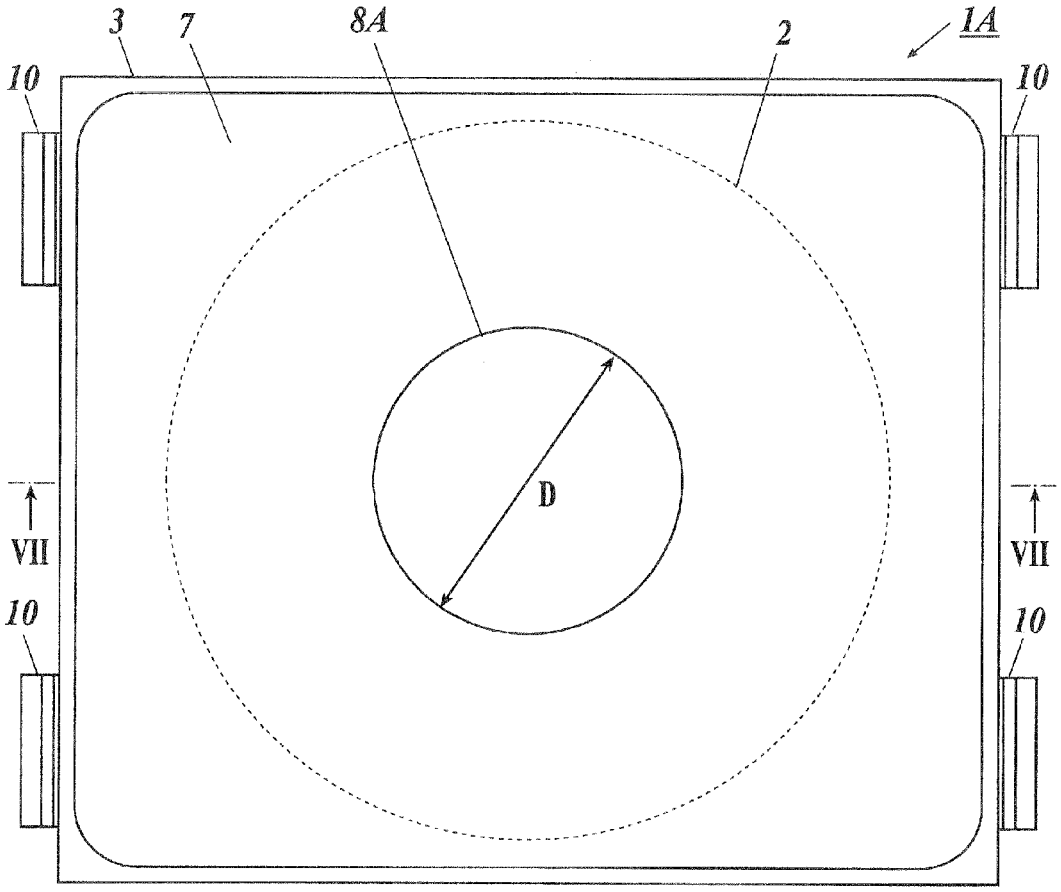
FIG. 7A is a plan view of a switch according to an exemplary embodiment.
Figure 7B:
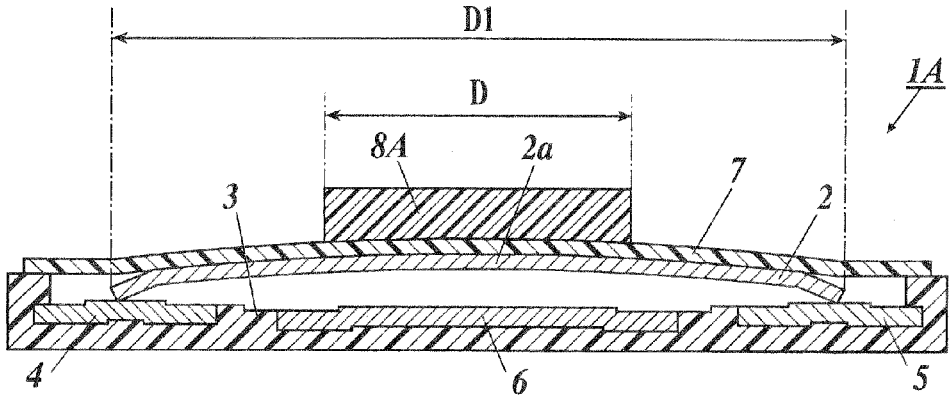
FIG. 7B is a sectional view of a switch of FIG. 7A along VII-VII line.
Figure 8:
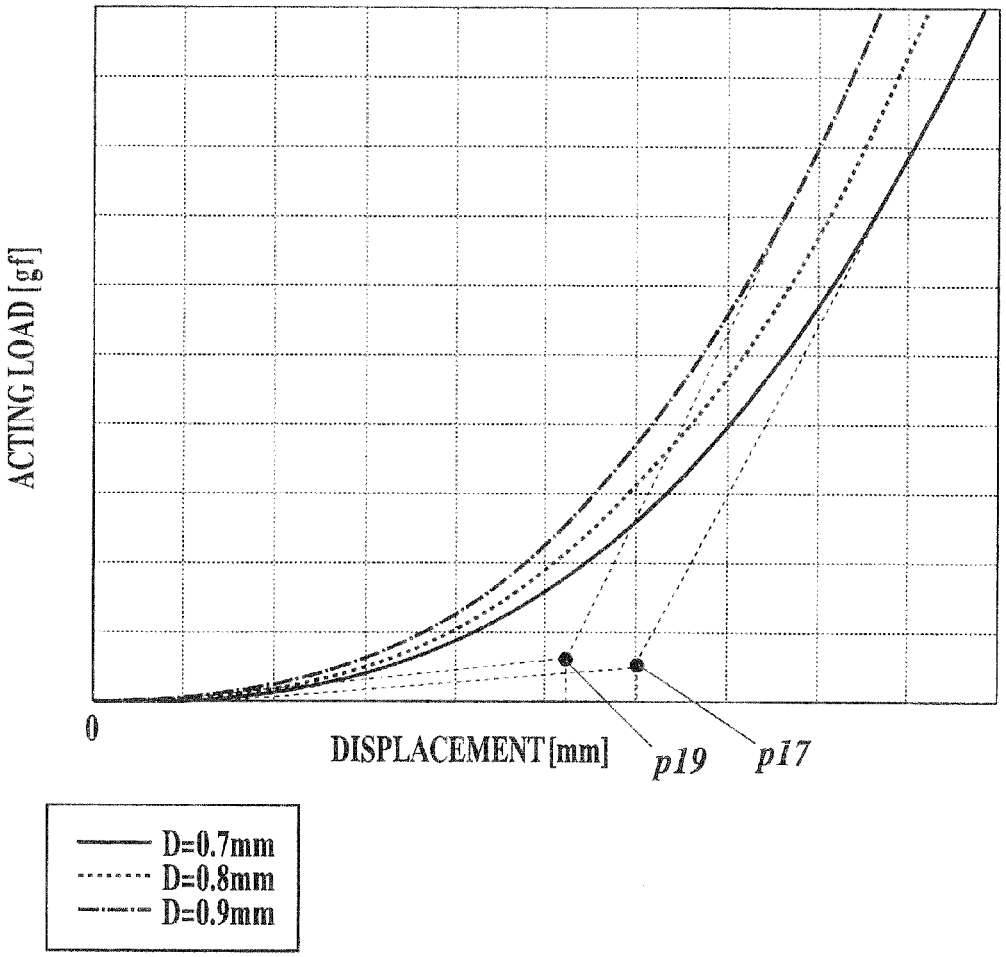
FIG. 8 is a graph showing an acting load to displacement characteristic of an Nub of a switch according to an exemplary embodiment.
Figure 9:
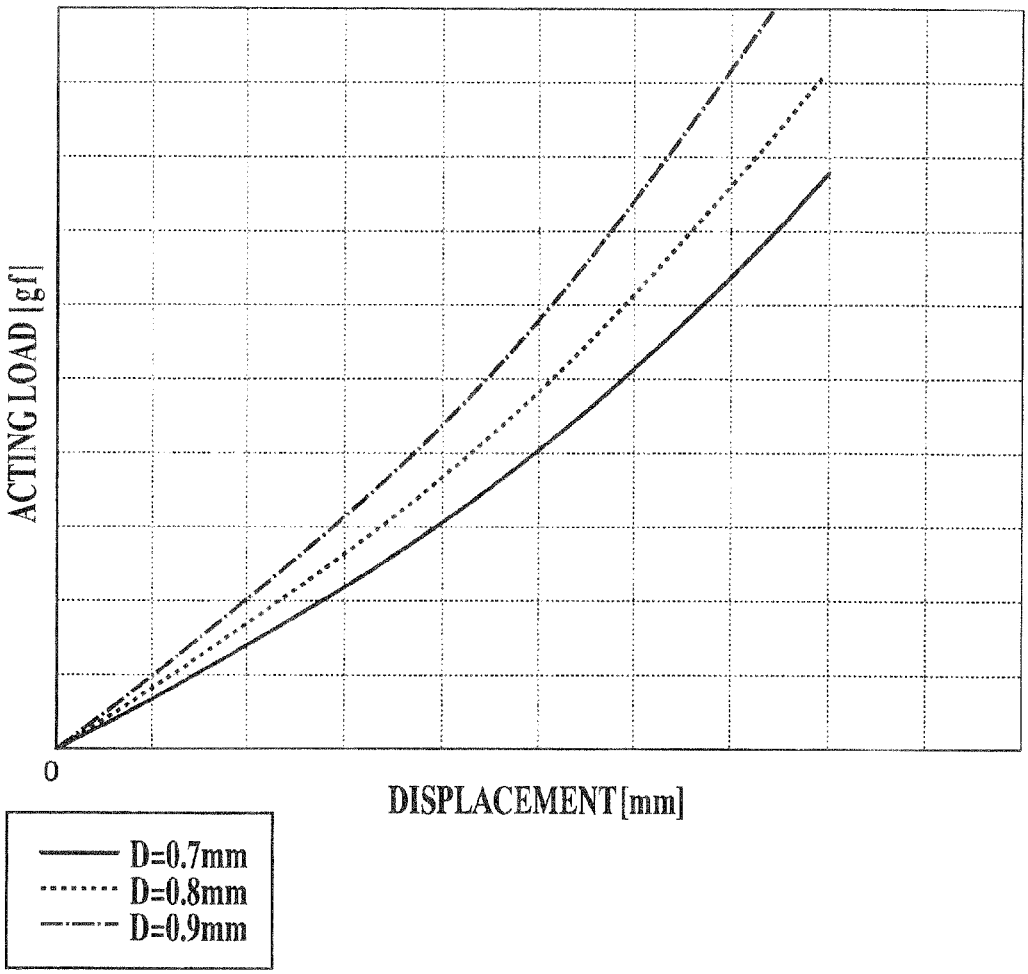
FIG. 9 is a graph showing an acting load to displacement characteristic of a switch according to an exemplary embodiment.
Figure 10:
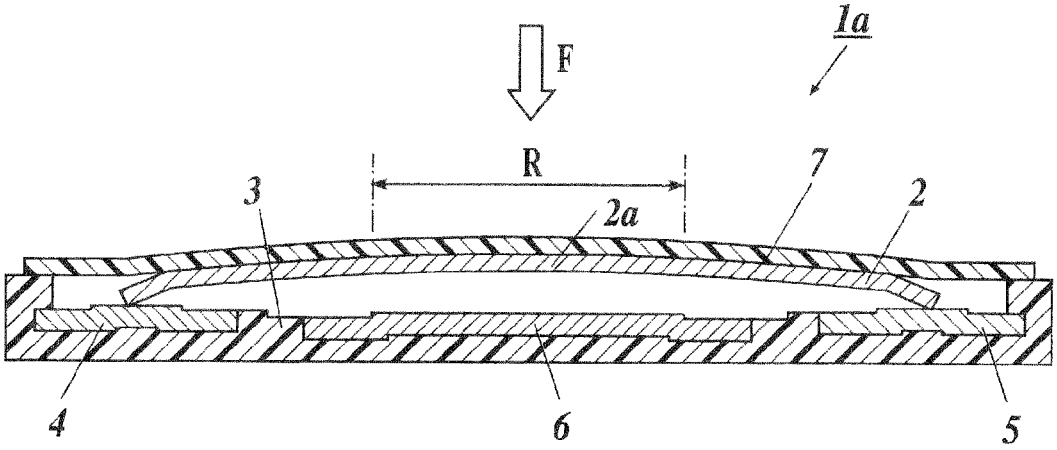
FIG. 10 is a sectional view of a first conventional switch.
Figure 11:
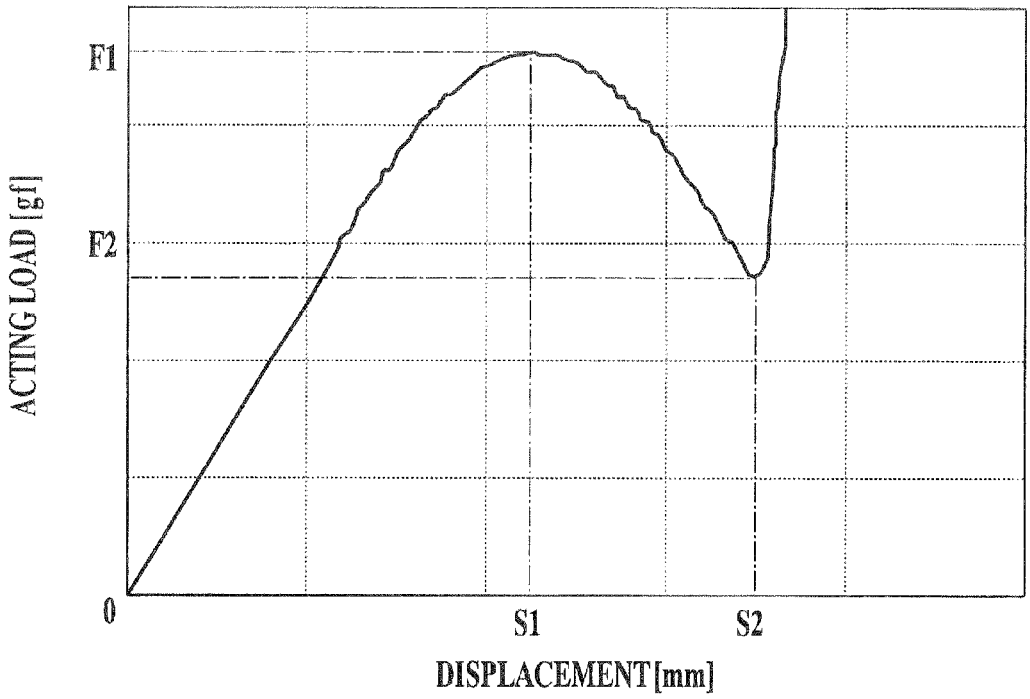
FIG. 11 is a graph showing an acting load to displacement characteristic of a first conventional switch.
Figure 12:
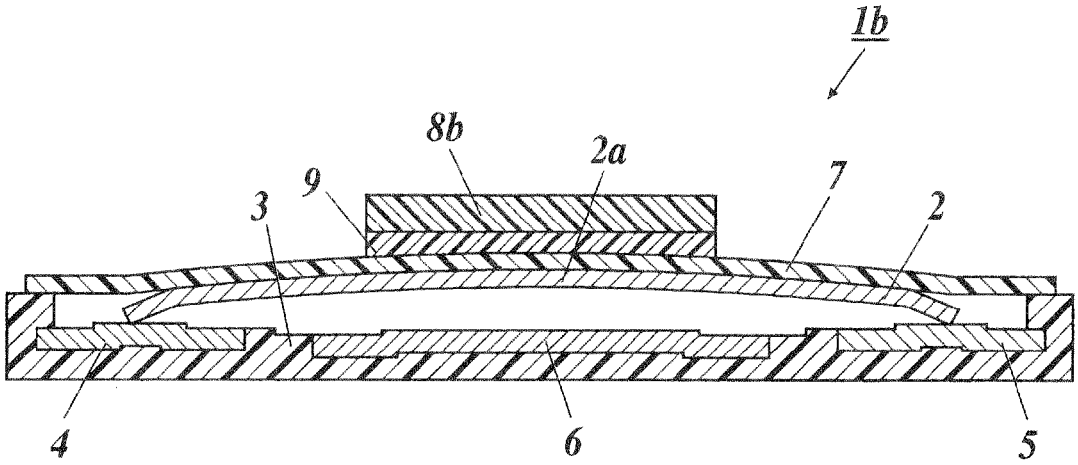
FIG. 12 is a sectional view of a second conventional switch.
Figure 13:
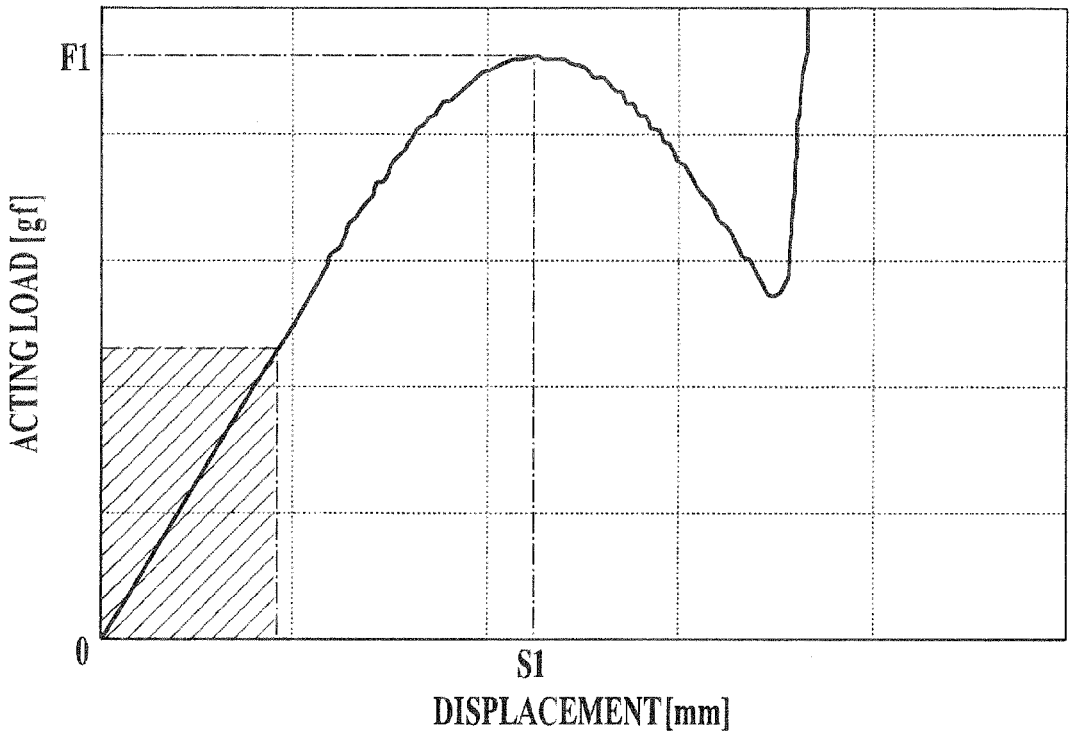
FIG. 13 is a graph showing an acting load to displacement characteristic of a second conventional switch.
Figure 14:
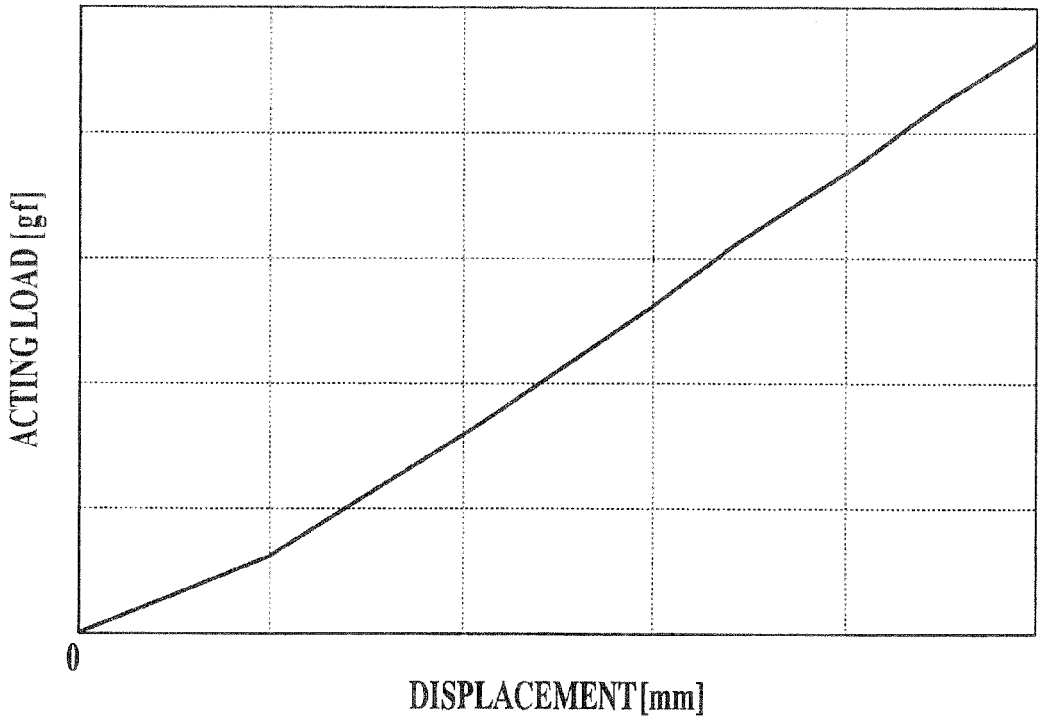
FIG. 14 is a graph showing an acting load to displacement characteristic of a conventional Nub.

Next, an adjustment of the tactile feel will be explained with reference to FIGS. 7 to 9. FIG. 7A is a planar structure of a switch 1A. FIG. 7B is a sectional structure of the switch 1A along VII-VII line in FIG. 7A. FIG. 8 is a graph showing an acting load to displacement characteristic of an Nub 8A of the switch 1A. FIG. 9 is a graph showing an acting load to displacement characteristic of the switch 1A.

The switch 1A shown in FIGS. 7A and 7B has a similar structure as that of the switch 1. The switch 1A has the Nub 8A instead of the Nub 8, and further includes four terminals 10, 10, 10 and 10. The terminals 10 are connected to the stationary contacts 4, 5 and/or 6. The Nub 8A is a cylindrical Nub as the Nub 8 as shown by FIGS. 7A and 7B and formed by a similar material to the Nub 8. As shown by FIGS. 7A and 7B, a diameter of the Nub 8A is designated as D and a diameter of the click spring 2 is designated as D1.

A measurement was performed using three switches 1A, 1A and 1A each having a diameter D of the Nub 8A of 0.7 (mm), 0.8 (mm) or 0.9 (mm). All switches 1A have the same fixed diameter D1 of 2.4 (mm).

Acting load to displacement characteristics of Nubs 8A themselves having different diameters D were measured. The results are shown in FIG. 8. The acting load to displacement characteristic of the Nub 8A itself having the diameter D=0.7 (mm) is shown in a solid line, the characteristic of the Nub 8A itself of the diameter D=0.8 (mm) is shown in a broken line and the characteristic of the Nub 8A itself of the diameter D=0.9 (mm) is shown in alternate long and short dashed lines.

Acting load to displacement characteristics of the switches 1A each having Nub 8A having different diameter D were measured. The results are shown in FIG. 9. The acting load to displacement characteristic of the switch 1A having the Nub 8A of the diameter D=0.7 (mm) is shown in a solid line, the characteristic of the switch 1A having the Nub 8A of the diameter D=0.8 (mm) is shown in a broken line and the characteristic of the switch 1A having the Nub 8A of the diameter D=0.9 (mm) is shown in alternate long and short dashed lines.

A tangent line of the acting load to displacement characteristic curve at a point of F1 is designated as a line having a gradient of spring constant k12. The designation k12 is a common word to every switch 1A having the Nubs 8A of the diameters of 0.7, 0.8 and 0.9 (mm). An intersection point of a line having a spring constant k11 and a line having the spring constant k12 of the Nub 8A of the diameter D=0.7 (mm) is designated as an intersection p17 and an intersection point of corresponding lines of the Nub 8A of the diameter D=0.9 (mm) is designated as an intersection p19, as shown in FIG. 8.

As can be seen from FIG. 8, the displacement from the origin point to the inflection point (intersection p17, p19) at which the gradient changes from the spring constant k11 to the spring constant k12 becomes small as the diameter D of the Nub 8A becomes large. As can be seen from FIG. 9, a non-linear rising of the acting load to displacement characteristic curve of the switch 1 becomes large as the diameter D becomes large.

Therefore, by enlarging the diameter D of the cylindrical Nub 8A and shortening the distance from the origin point to the inflection point, it becomes possible to decrease the displacement in a low-load region and fabricate a switch 1A having a small play and sharp tactile feel by using such an Nub. On the other hand, by decreasing the diameter D and elongating the distance from the origin point to the inflection point, it becomes possible to suppress increasing of the load in a small-displacement region and fabricate a switch 1A having a smooth load-increase characteristic by using such an Nub.

According to an exemplary embodiment, the switch 1 includes the click spring 2, stationary contacts 4, 5, and 6, spring holding sheet 7, switch base 3 and Nub 8 whose acting load to displacement characteristic is non-linear and is disposed on the spring holding sheet. The spring constants k11, k12 and k3 and the displacement s11 of the intersection point p11 satisfy the inequalities (1), (2) and (3). As a result, a non-linear acting load to displacement characteristic can be obtained for the switch 1 and comfortable operation feel can be obtained even when the switch is downsized.

The Nub 8 is formed in cylindrical so as to obtain a desired displacement s11. The larger the diameter D of the cylindrical shape of the Nub 8, the smaller the displacement s11 of the intersection p11 (inflection point) of the lines having the spring constants k11 and k12 becomes, and vice versa. Therefore, it is possible to control the acting load to displacement characteristic of the switch 1A by changing the shape of the Nub 8A. Specifically, by enlarging a diameter D of a cylindrical Nub and shortening a distance from the origin point to an intersection (inflection point), it is possible to decrease a displacement in a low-load region and fabricate a switch having a small play and sharp tactile feel by using such an Nub. On the other hand, by decreasing a diameter D and elongating a distance from the origin point to an intersection (inflection point), it is possible to suppress increasing of a load in a small-displacement region and fabricate a switch having a smooth load-increase characteristic by using such an Nub.

An exemplary embodiment above explained is a mere example of a switch according to the present invention and not for limiting the invention. It should be noted that a detailed structure, each element or each operation of the switch of an exemplary embodiment above explained can be modified within the gist of the present invention.

What is claimed is:

1. A switch comprising:

a click spring that generates a tactile action by being pressing down and comprises a circumferential edge and a movable contact;

a spring holding sheet attached on the click spring;

a switch base which is provided with a first stationary contact and a second stationary contact, and which supports the spring holding sheet; and a nub disposed on the spring holding sheet and having a non-linear acting load to displacement characteristic;

wherein the circumferential edge of the click spring is continuously in contact with the first stationary contact;

wherein the movable contact of the click spring is configured to contact the second stationary contact at a time of the tactile action; and wherein a spring constant k11, a spring constant k3, a spring constant k12, a displacement S1, and a displacement s11 satisfy following inequalities:

$$k11<k3,$$

$$k12>k3,$$

and $$0<s11<S1,$$

where:

the spring constant k11 is a gradient of a tangent line at an origin point of an acting load to displacement characteristic curve of the nub, the displacement S1 is a displacement corresponding to a peak acting load in an acting load to displacement characteristic curve of the click spring and the spring holding sheet, the spring constant k3 is a gradient of a line connecting a point corresponding to the peak acting load and an origin point of the characteristic curve of the click spring and the spring holding sheet, the spring constant k12 is a gradient of a tangent line at an arbitrary point within a non-linear portion of the characteristic curve of the nub, and the displacement s11 is a displacement corresponding to an intersection point of the line having the gradient k11 and the line having the gradient k12.

2. The switch according to claim 1, wherein the nub is configured to obtain a desired displacement s11.

3. The switch according to claim 2, wherein the nub is formed in a cylindrical shape having a diameter to obtain the desired displacement s11, wherein a value of the displacement s11 decreases as the diameter of the cylindrical shape increases.

* * * * *